US006190818B1

(12) United States Patent
Ioannidis et al.

(10) Patent No.: US 6,190,818 B1
(45) Date of Patent: Feb. 20, 2001

(54) DISPERSION PROCESS

(75) Inventors: Andronique Ioannidis, Webster; Markus R. Silvestri, Fairport; Andrew R. Melnyk, Rochester; Harry F. Freitas, Jr., Rochester; John S. Chambers, Rochester; Harold F. Hammond, Webster; Cindy C. Chen, Rochester, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/519,367

(22) Filed: Mar. 6, 2000

(51) Int. Cl.[7] ..... G03G 5/00; B02C 4/04
(52) U.S. Cl. ..... 430/135; 106/412; 241/27
(58) Field of Search ..... 430/135; 106/412; 241/27

(56) References Cited

U.S. PATENT DOCUMENTS 5,141,837 * 8/1992 Nguyen et al. ..... 430/135
5,217,750 * 6/1993 Kowalczy et al. ..... 430/135
5,418,107 5/1995 Nealey et al. ..... 430/132

* cited by examiner

*Primary Examiner*—John Goodrow
(74) *Attorney, Agent, or Firm*—John L. Haack

(57) ABSTRACT

A process for forming a dispersion including forming a mixture including agglomerates of primary particles, a film forming binder and a solvent for the binder, the primary particles having an average size of less than about 500 nanometers, applying sufficient heat energy to the mixture while stirring to disintegrate the agglomerates into separate primary particles having an average size of less than about 500 nanometers to form a dispersion substantially free of agglomerates, and slowly cooling the dispersion to maintain separation between the primary particles in the dispersion.

25 Claims, No Drawings

DISPERSION PROCESS

BACKGROUND OF THE INVENTION

This invention relates in general to dispersion processes and, more specifically, to a process for forming dispersions of particles in a solution of a film forming binder.

A photoconductive layer for use in electrophotography may be a single layer or it may be a composite layer. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between the contiguous charge transport layer and the supporting conductive layer. In another embodiment, the charge transport layer is sandwiched between the supporting electrode and a photoconductive layer.

Photosensitive members (photoreceptors) having at least two electrically operative layers as described above provide excellent images when charged with a uniform electrostatic charge, exposed to a light image and thereafter developed with finely developed electroscopic marking particles. A key component of modern photoreceptors is the charge generation layer (CGL) which absorbs imaging light and produces the conducting charge that is used to discharge the charge on the photoreceptor surface and hence form an electrostatic image. The material component of the charge generation layer that performs this photogeneration of charge is a polycrystalline pigment. For reasons of electrical performance and cycling stability it is desirable that the charge generation layer be as thin as possible, yet absorb more than 90 percent of the light to which it is exposed. Thus, it is desirable to coat charge generation layer to a thickness of about 0.1 micrometer to about 0.2 micrometer (100 nanometers to 200 nanometers) taking into account the binder polymer. To coat such thin layers requires that the pigment particles be smaller than about 0.1 micrometer. (100 nanometers) Furthermore, the presence of larger pigment agglomerates causes a non-uniformity of photoelectrical response and is one of the causes of undesirable charge deficient spots (CDS). Hence, pigment dispersions require milling of the pigment in the presence of a binder polymer and solvent. Techniques such as shaking or rolling the dispersion with steel or other hard material ball (shot) are used to accomplish this milling.

The grinding of particles followed by dispersion of the ground particles in a solution requires prolonged grinding times and multiple processing steps. These grinding processes may require days of milling to achieve the proper particle size. Moreover, the mechanical grinding action of the shot damages the crystal surfaces and also leaves behind residue of the grinding (shot) material, e.g. metal particles in case of steel shot. Both effects can be detrimental to the electrical performance of the charge generating layer. The grinding can also involve, for example, pressure and shearing forces of attriters using considerable energy. Prolonging the grinding treatment in order to achieve the smallest possible particle sizes adversely affects the performance of high purity materials such as photoconductive or other materials such as pharmaceutical materials. Further, the longer the grinding treatment is continued, the worse the performance of the ground material product. For example, ground photoreceptor particles become less and less responsive and sensitive, the longer grinding continues. To obtain finely ground particles with conventional grinding processes, days of grinding are required to reduce materials such as metal-free phthalocyanine photoconductive particles into particles on the scale of tens of nanometers. This poses a practical difficulty, due to the time demand and also due to the detrimental effects of long milling described above. Thus, an optimum time, with an attendant trade-off in particle size and therefore charge generating layer thickness, is often chosen. However, even to achieve particle sizes on the scale 0.05–0.1 micrometers requires several hours of milling. Long grinding also consumes excessive energy and forms a large size distribution of particles, including undesirable agglomerates. Further, grinding medium residue, even in parts per million amounts, produce significant adverse effects in sensitive photoconductive materials such as dark decay, cycle up, residual voltage, and the like. These grinding medium residue include materials such as metals, metal salts, ceramic particles, and the like, which can also cause charge deficient spots in photoreceptors. Although some grinding media leave less residue, they tend to be more expensive. In addition, the material being pulverized tends to adhere to the grinding medium leading to loss of product when the grinding medium is separated from the material being pulverized. Prolonged grinding can also increase the damage to the crystal structure of some particles. Such damage to crystal structure can adversely affect the electrical performance of some photoreceptor materials.

INFORMATION DISCLOSURE STATEMENT

U.S. Pat. No. 5,418,107 to Nealey, et al., issued May 23, 1995—A process is disclosed for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

While the above mentioned process may be suitable for their intended purposes, there continues to be a need for improved processes for forming stable dispersions.

BRIEF SUMMARY OF THE INVENTION

It is, therefore, an object of the present invention to provide an improved process for forming stable dispersions.

It is another object of the present invention to provide an improved process which disintegrates particle agglomerates of primary particles.

It is still another object of the present invention to provide an improved process which disperses primary particles in a solution of a film forming binder.

It is yet another object of the present invention to provide an improved process which utilizes simpler equipment.

It is another object of the present invention to provide an improved process which is free of shot.

It is still another object of the present invention to provide an improved process for forming dispersions which is dramatically faster, less energy consuming and less damaging to primary particles than previous known grinding processes.

The foregoing objects and others are accomplished in accordance with this invention by providing a process for forming a dispersion comprising forming a mixture comprising agglomerates of primary particles, a film forming binder and a solvent for the binder, the primary particles having an average size of less than about 500 nanometers, applying sufficient heat energy to the mixture while stirring to disintegrate the agglomerates into separate primary particles having an average size of less than about 500 nanometers to form a dispersion substantially free of agglomerates, and slowly cooling the dispersion while stirring to maintain cohesion of the dispersion.

The agglomerates of primary particles disintegrated by the process of this invention generally have an average agglomerate size of between about 500 nanometers and about 5000 nanometers. These agglomerates may be obtained by any suitable technique. For example they may be formed as the primary product of the material synthetic process, or as the product of the purification method used for the material, such as recrystallization or sublimation. Pigment agglomerates are commercially available.

Agglomerates of primary particles having an average size greater than about 500 nanometers may be obtained by any suitable technique. If desired, grinding with any suitable medium may be employed to process agglomerates or primary particles prior to, or subsequent to, the process of this invention.

The primary and agglomerate particle material may be any suitable inorganic or organic material. Preferably, the primary particles are monocrystalline particles and the monocrystalline particles in the agglomerate particles are unaligned. The process of this invention may also be utilized for any suitable non-crystalline agglomerate. The expression "monocrystalline" as employed herein is defined as a particle that is a single crystal. However, the primary particle may itself be composed of multiple single crystals, in which case it is polycrystalline. Agglomerates include groups of monocrystalline or polycrystalline particles.

The primary particles having an average size of less than about 500 nanometers Preferably, the average particle size of the primary particle is less than about 200 nanometers (0.2 micrometer). More preferably, the primary particles have an average particle size that is sub-micron and less than about 100 nanometers. Especially preferred are obtained when primary particles have an average particle size of less than about 50 nanometers because highly stable dispersions are formed. Optimum results are achieved with an average particle size of about 10 nanometers to 50 nanometers (0.01 micrometer–0.05 micrometer) range. The primary particles are used with the film forming binder to form a thin continuous charge generating layer. After drying, the charge generating layer should have a uniform thickness. Thus, the particles dispersed in the dried charge generator layer should have a particle size less than about the average layer thickness of the charge generating layer to avoid layer break-up; uneven coatings, and large particles protruding out of the layer. When viewed in Transmission Electron Microscopy (TEM), in the state of some of the materials after coating and drying, i.e., as a solid film, the dispersed particles may group together, but the primary particles (which can include smaller agglomerates) are still distinguishable within a group.

The process of this invention applies to the electrostatographic materials, as well as any other suitable materials, such as pharmaceuticals, photovoltaic cells, optoelectronic devices such as photodiodes, and the like. Preferably, the primary particles are photoconductive pigment particles. Any suitable pigment may be utilized. Typical pigment particles include, for example, phthalocyanines, such as metal-free phthalocyanine such as the well known x-form metal-free phthalocyanine, metal phthalocyanines, such as the many known polymorphs of titanyl (oxotitanium) phthalocyanine, hydroxygallium phthalocyanine and chloroindium phthalocyanine, perylenes such as benzimidazole perylene, azo or bisazo pigments, and the like.

Any suitable film-forming binder may be utilized in the process of this invention. Preferably, the film forming binder is a film forming polymer. Typical film forming polymers include, for example, polysiloxanes, polycarbonates, polyesters, polyamides, polyvinylbutyrals, and the like. These film forming binders are introduced by the process of this invention between the primary particles and keep the particles apart after they have been separated and also prevent the particles from reattaching to each other. A preferred polyvinylbutyral film forming binder is the reaction product of a polyvinyl alcohol and butyraldehyde in the presence of a sulphuric acid catalyst. The hydroxyl groups of the polyvinyl alcohol react to give a random butyral structure which can be controlled by varying the reaction temperature and time. The acid catalyst is neutralized with potassium hydroxide. The polyvinyl alcohol is synthesized by hydrolyzing polyvinyl acetate. The resulting hydrolyzed polyvinyl alcohol may contain some polyvinyl acetate moieties. The partially or completely hydrolyzed polyvinyl alcohol is reacted with the butyraldehyde under conditions where some of the hydroxyl groups of the polyvinyl alcohol are reacted, but where some of the other hydroxyl groups of the polyvinyl alcohol remain unreacted. For utilization in the photoconductive layer of this invention the reaction product should have a polyvinyl butyral content of between about 50 percent and about 75 mol percent by weight, a polyvinyl alcohol content of between about 12 percent and about 50 tool percent by weight and a polyvinyl acetate content up to about 5 mol percent by weight. These film forming polymers are commercially available and include, for example, Butvar B-79 resin (available from Monsanto Chemical Co.) having a polyvinyl butyral content of about 70 mol percent, a polyvinyl alcohol content of 28 mol percent and a polyvinyl acetate content of less than about 2 mol percent, a weight average molecular weight of between about 50,000 and about 80,000; Butvar B-72 resin (available from Monsanto Chemical Co.) having a polyvinyl butyral content of about 56 tool percent by weight, a polyvinyl alcohol content of 42 mol percent and a polyvinyl acetate content of less than about 2 mol percent, a weight average molecular weight of between about 170,000 and about 250,000; and BMS resin (available from Sekisui Chemical) having a polyvinyl butyral content of about 72 mol percent, a vinyl acetate group content of about 5 mol percent, a polyvinyl alcohol content of 13 mol percent and a weight average of molecular weight of about 93,000. Preferably, the weight average molecular weight of the polyvinyl butyral utilized in the process of this invention is between about 40,000 and about 250,000. These polyvinylbutyrals are described in, for example, U.S. Pat. No. 5,418,107, the entire disclosure thereof being incorporated herein by reference.

Any suitable solvent may be utilized in the process of this invention. The solvent should dissolve the film forming binder. Also, the pigment or other agglomerate particles to be dispersed should be insoluble in the solvent. Typical solvents include, for example, water, methylene chloride, tetrahydrofuran, monochlorobenzene, toluene, butyl acetate, and the like.

Any suitable combination of agglomerate particles, film forming polymer and solvent may be utilized to form the mixture to be treated by the process of this invention. Preferably, the starting mixture and the final dispersion product of the process of this invention comprises between about 10 and about 90 percent by weight agglomerate particles and between about 90 and about 10 percent by weight film forming polymer, based on the total weight of solids in the dispersion. As to the particles to binder proportions, the more particles utilized in the process, the faster the process may be operated. The total weight of the solids in the final dispersion is preferably between about 2 percent by weight and about 40 percent by weight, based on the total weight of the dispersion. These proportions may also be used for the starting mixture. Proportions outside this range may be used so long as the objectives of this invention are met. The viscosity of the dispersion affects how well the dispersion forms a coating and varies with the specific solvent and polymer employed.

The process of this invention involves self-shearing, but the mixture should not contain too much particles. Also, shear can be adversely affected if the mixture is too dilute. For example, satisfactory results may be obtained with a 5 percent by weight solids mixture. The viscosity of the mixture being treated is important. The viscosity is affected by the amount of solids in the mixture. If a pigment is employed, milling of a base comprising a high concentration of pigments is unnecessary. A typical mixture may comprise about 5 percent by weight solids, the remaining being solvent. This can be applied by any suitable dip-coating apparatus. A 10 percent by weight solids mixture, for example, produces acceptable results. A 20 percent by weight solids mixture requires longer processing time.

Any suitable technique may be utilized to heat the mixture. Typical heating techniques include hot gas bubbles, hot plates, heating jackets, heat exchangers, heated vanes, heated tubes, and the like. Other typical means for imparting thermal energy include, for example, microwave heating, infrared heating, and the like. Thus, it is important that thermal energy also be imparted to the mixture with stirring. This heat energy can be imparted by a separate heating apparatus, or may be imparted by any suitable stirring apparatus itself, such as an insulated blender system which allows retention and accumulation of heat generated by the blender. The delivery of heat energy to the mixture is preferably uniform. Stirring of the mixture during heating both facilitates uniform heating and is an essential step to forming a dispersion by disintegrating the agglomerates into smaller agglomerates or separate primary particles.

The application of sufficient heat energy to the mixture while stirring disintegrates the agglomerates into separate primary particles to form a dispersion substantially free of agglomerates. Generally, lower temperatures require longer processing time. Preferably, sufficient heat energy should be applied to the mixture to raise the temperature of the mixture between about the boiling point temperature of the mixture and a temperature about 2° C. below the boiling point of the mixture to agitate the mixture. The temperature employed should be below the decomposition temperature of the agglomerate material, film forming binder and solvent used.

Preferably, the process of this invention is employed to disperse the primary particles by utilizing heat to cause cavitation of the liquid mixture during boiling. This cavitation, or vibration, imparts kinetic energy in combination with stirring. However, vibration can be sufficient where the temperature of the mixture is merely brought to near boiling. It is believed that violent Brownian motion occurs during the treatment process.

Preferably, sufficient heat energy is applied to the mixture to heat the mixture to a temperature between about 40° C. and about 120° C. If the boiling point of the mixture is reached at a temperature, below 120° C., it is not necessary to apply heat energy beyond what is necessary to reach the boiling point. Thus, the maximum temperature to which the mixture is heated is the boiling point of the mixture.

Ramping the temperature up to about the boiling point temperature of the mixture is important. Thus, for example, placement of a mixture at ambient temperature for processing on a preheated hot plate medium can cause the mixture to form an undesirable sludge. It is also important that as the applied heat energy is ramped up, it is accompanied by stirring. The stirring distributes the heat, assists in preventing sludge formation and promotes effective disintegration of the agglomerates.

The application of heat energy to the mixture during the ramping stage should be at a rate which maintains the mixture free of sludge formation. Where the agglomerates and primary particles have a decomposition temperature, the temperature of the agglomerates and primary particles should be maintained below about the decomposition temperature. Similarly, where the solvent and/or binder has a decomposition temperature, the temperature of the mixture should be maintained below about that decomposition temperature.

The proportion of solids in the mixture can change depending on whether it is diluted with the addition of additional solvent, or some of the solvent evaporates during processing. If desired, a stream of fresh solvent may be gradually added to wash the container walls down and replenish solvent lost to evaporation. The rate of addition of this solvent preferably avoids undue chilling of the mixture. If desired, a condenser may be employed to reflux the escaping solvent. When solvents having a boiling point between about 40° C. and about 120° C. are employed, the mixture should be at the boiling, or near boiling temperatures following the ramping step because sufficient energy must be imparted to the mixture being treated to achieve adequate disintegration of the aggregates. Boiling appears to increase agitation of the primary particles in the mixture. However, boiling of the mixture need not be reached with solvents having a very high boiling point, e.g. solvents such as cyclohexanone. Generally, the highest temperature obtainable without degradation of the components is preferred. Typical processing temperatures include, for example, between about 40° C. and about 120° C.

Preferably, the processing vessel is vented during boiling. This prevents or minimizes the formation of froth. Excessive froth can carry particles to upper regions of the treatment vessel where it coats the vessel wall thereby resulting in loss of yield.

Generally, the time for disintegration of the agglomerates during heating and stirring depends upon the concentration of the mixture to be treated. The more dilute the mixture, the more time is required for processing. It appears that a bell curve result occurs with the process of this invention because a more concentrated mixture also requires more processing time (it takes longer to heat the mixture because there is more thermal mass). A temperature profile vs. time can be prepared for different concentrations of the materials employed.

Any suitable stirring device may be utilized. Typical stirring devices include, for example, stir bars, magnetic stir bars, blenders, shaking systems, ultrasonic systems, bubbling gas, and the like. Stirring is carried out while applying heat energy to the mixture during the ramping, boiling or near boiling and simmering stages. As employed herein, the expression "stirring" is defined as sufficient circulation speed or agitation of the mixture to produce and maintain a visually detectable movement of the mixture. If stirring is too slow or too weak, visually detectable movement of the mixture will stop due to the viscosity of the mixture and/or the beginning of sludge formation.

Stirring can also be used while slowly cooling the dispersion. Stirring alone without sufficient heat energy is insufficient to achieve the degree of dispersion achieved with the process of this invention. A blender by itself will not produce the desired results. All these components impart shear, pressure, and crushing energy.

It is also preferred that the treated mixture be cooled slowly with stirring. Quenching should be avoided because it can cause agglomeration and/or separation of the mixture into solid and liquid phases. Cooling should not be so rapid that it causes agglomerates to form. Cooling should also not be so rapid that it causes phase separation of the mixture. Slow cooling of the dispersion while stirring maintains separation between the primary particles in the dispersion. Thus, cooling should be at a rate which maintains the dispersion free of agglomerate formation and maintains the dispersion as one phase.

The process of this invention involves dispersion of primary particles, as opposed to size reduction of primary particles. The dispersed primary particles have an average particle size less than about 100 nanometers and, more preferably, less than about 50 nanometers.

It is hypothesized that the primary particles of agglomerates of monocrystalline or polycrystalline materials are broken up by a combination of mechanical and heat energy to dispel physiabsorbtion and the presence of dissolved binder aids in the prevention of recombination.

After treatment, the treated composition of this invention forms a stable liquid dispersion free of agglomerates and does not separate, even at high concentrations.

An advantage of this invention includes starting the milling process with the proportions employed in final compositions for coating. Preferably, the composition solids comprises between about 10 percent by weight and about 90 percent by weight pigment and between about 90 percent by weight and about 10 percent by weight film forming polymer. However, the specific weight percent selected for the ratio of pigment to polymer, depends on the final coating proportions desired.

The process of this invention disintegrates particle agglomerates of primary particles and disperses the primary particles in film forming binders that is dramatically faster, less energy consuming and less damaging to the primary particles than known prior grinding processes. The process supplants the pressure and shearing forces of attriters and grinding methods with heat and stirring to dissociate larger polycrystalline particles into smaller crystallites in the presence of the polymer and uses far less energy than was previously thought to be necessary.

Surprisingly, the process of this invention can produce primary particles of a size below the resolution (10 nanometers) of Transmission Electron Microscopy and can produce a stable dispersion with some materials in less than about one hour. The process of this invention also minimizes loss of product adhering to processing equipment and reduces damage to the crystal structure of some particles. For example, photoconductive organic pigment agglomerates of primary particles such as metal-free phthalocyanine have been disintegrated within one hour and organic pigment agglomerates of primary particles such as perylene dimers have been disintegrated within 3 and ½ hours using the low energy process of this invention.

Photoreceptors are well known in the art of electrophotography. Photoreceptors typically comprise layers as a subbing layer, a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the entire disclosures of these patents being incorporated by reference.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member.

The charge barrier layer may comprise any suitable material including, for example, polymers such as polyvinylbutyral, epoxy resins, polyesters, polysiloxanes, polyamides, polyurethanes, and the like. Materials for the charge barrier layer are disclosed in U.S. Pat. Nos. 5,244,762 and 4,988,597, the disclosures of which are totally incorporated by reference.

A typical charge generating layer comprises photoconductive particles in a solution of a film forming polymer. Typical charge generating particles include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; azulene compounds; and the like. Typical film forming polymers include, for example, polyester, polystyrene, polyvinylbutyral, polyvinyl pyrrolidone, methyl cellulose, polyacrylates, cellulose esters, and the like. Generally, charge generating layer dispersions for immersion coating mixtures contain pigment and film forming polymer in the weight ratio of from 20 percent pigment/80 percent polymer to 80 percent pigment/20 percent polymer. The pigment and polymer combination are dispersed in solvent to obtain a solids content of between about 3 and about 6 weight percent based on total weight of the mixture. However, percentages outside of these ranges may be employed so long as the objectives of the process of this invention are satisfied. A representative charge generating layer coating dispersion comprises, for example, about 2 percent by weight hydroxy gallium phthalocyanine; about 1 percent by weight of terpolymer of vinyl acetate, vinyl chloride, and maleic acid (or a terpolymer of vinylacetate, vinylalcohol and hydroxyethylacrylate); and about 97 percent by weight cyclohexanone.

Typical charge transport layers comprise suitable charge transport material in a solution of a film forming polymer. Typical charge transport materials include, for example, compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds. Typical film forming polymers include, for example, resins such as polycarbonate, polymethacrylates, polyarylate, polystyrene, polyester, polysulfone, styrene-acrylonitrile copolymer, styrene-methyl methacrylate copolymer, and the like. An illustrative charge transport layer coating composition contains, for example, about 10 percent by weight N,N'-diphenyl-N,N'-bis(3-methylphenyl)-[1,1'-biphenyl]-4,4'diamine; about 14 percent by weight poly(4,4'-diphenyl-1,1'-cyclohexane carbonate (400 molecular weight); about 57 percent by weight tetrahydrofuran; and about 19 percent by weight monochlorobenzene.

Surprisingly some photoreceptors dip coated with processed materials of this invention, do not exhibit any residual voltage.

Although the process of this invention should not be constrained by theory, it is hypothesized that the combining of the film forming polymer, pigment agglomerates and solvent to form a mixture, heating the mixture to about boiling while stirring and simmering maximizes available forces that leads to interspersion of polymer between primary particles in an agglomerate to disintegrate the agglomerates without the introduction of any other material in the generation dispersion (additives adversely affect electrical properties, as a rule) and avoids a problem associated with steel shot in milling. It also avoids any damage to the primary particle surfaces (as can occur with shearing forces in milling) while the relatively low temperature ensures no crystal transitions where the particles are crystals.

PREFERRED EMBODIMENT OF THE INVENTION

A number of examples are set forth herein below and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Dispersion of Metal-Free Pthalocyanine in Polycarbonate

A 50/50 weight percent ratio of 0.8 gram of x-form metal free phthalocyanine pigment agglomerates and 0.8 gram of poly(4,4'-diphenyl-1,1'-cyclohexane carbonate (Z-type polycarbonate) were mixed together in a vessel with 40 milliliters of methylene chloride solvent. A magnetic stir bar was used to stir the mixture. The temperature of the resulting mixture was ramped up from ambient room temperature on an adjustable hotplate which was also initially at ambient room temperature. The temperature control setting of the hot plate was then set to "Low" to raise the temperature of the mixture to ~30° C. Five minutes later, the temperature control setting of the hot plate was set to "1" to raise the temperature of the mixture to about to ~40° C. About 5–10 minutes later, the temperature control setting of the hot plate was set to "2" to raise the temperature of the mixture to about to ~50° C. Ramping of the temperature was important because placement of a cool vessel and contents on a preheated hot-plate can cause a glue-like sludge to form on the bottom that is extremely difficult to disperse. The mixture was then boiled with some frothing for 20 minutes. The vessel was uncapped during boiling. As solvent evaporated during the boiling stage, a thin stream of solvent was slowly (so as not to rapidly cool the mixture) added to maintain the solid/solvent ratio and to wash down larger particles that were deposited on the vessel walls by the boiling and frothing. After 20 minutes of boiling, the heat setting was lowered to "1", the vessel opening was lightly capped with a glass cap, and the mixture was allowed to simmer for ~30 minutes. Solvent was added periodically in about 10–15 minute intervals to maintain solvent/solid ratios. The same process has been repeated with an identical mixture using a condenser attached to the flask so that no solvent is lost to evaporation and the same times were required for the various process steps. The mixture was stirred with the magnetic stir bar during the ramping, boiling and simmering heating periods. Upon completion of the 30 minutes of simmering, the vessel was removed from the hotplate. The resulting dispersion was judged by the naked eye. The liquid looked like paint and showed no "clouds" on swirling. When ~1 milliliter of the dispersion was squirted onto a glass plate, the mixture was uniform, smooth, and no particles (agglomerates) were visible. This dispersion contained 0.8 gram of the phthalocyanine particles and 0.8 gram poly(4,4'-diphenyl-1,1'-cyclohexane carbonate in 35 milliliters methylene chloride and was stable for at least 4 weeks, after which it was all used up in coatings.

EXAMPLE II

Dispersion of Perylene Dimer in Polycarbonate

A 50/50 weight percent ratio of 0.5 gram of perylene dimer pigment (described in U.S. Pat. No. 5,645,965 and pending U.S. patent application Ser. No. 09/316,587, entitled "Perylenes", filed in the names of Hsiao et al., on May 21, 1999, the entire disclosures of the patent and patent application being incorporated herein by reference) and 0.5 gram of poly(4,4'-diphenyl-1,1'-cyclohexane carbonate (Z-type polycarbonate) were mixed together in a vessel with 40–60 ml of methylene chloride solvent. The temperature of the resulting mixture was ramped up from ambient room temperature on an adjustable hot plate to ~40° C. over 15 minutes and then boiled for 1 hour. Ramping of temperature was important because placement of a cool vessel and contents on a preheated hot-plate can cause a glue-like sludge to form on the bottom that is extremely difficult to disperse. The mixture was then simmered for 2 hours. During the ramping, boiling and simmering heating periods, the mixture was stirred with a magnetic stir bar. As solvent evaporated during the boiling stage, a thin stream of solvent (so as not to rapidly cool the solution) was added to maintain the solid/solvent ratio and to wash down larger particles that are deposited on the vessel walls by agitation of the mixture due to boiling. During the simmering stage, solvent was added periodically (10–15 minutes) to maintain the solid/solvent ratio. The container was uncapped during boiling, but lightly capped during simmering. The dispersion was stable for at least 8 weeks.

EXAMPLE III

Dip Coating with the Phthalocyanine Dispersion of Example I

Small strips of conductive substrate were dip coated twice with the x-form metal free phthalocyanine dispersion prepared in Example I to form a dried charge generating layer having a thickness of ~0.5 micrometer. Transmission electron microscopy (TEM) examination of one coated sample coated with the charge generating layer alone revealed pigment sizes below the resolution (<0.01 $\mu$m) of the TEM.

A 20 micrometer thick charge transport layer was formed on the charge generating layer by drop (puddle) casting followed by drying at 110° C. for 25 minutes. The charge transport layer coating composition contained a 1:1 weight ratio of N,N'-diphenyl-N,N'-bis(3-methylphenyl)-1,1'-biphenyl-4-4'-diamine in polycarbonate film forming binder (available as Makrolon® from Farbenfabricken Bayer A.G.) dissolved in methylene chloride. The charge transport layer covered generator layer was swelled by the charge transport layer coating, averaged 0.8 $\mu$m thickness and was broken-up into particles of 0.1–0.3 $\mu$m diameter. This sample was tested electrically in a motionless scanner and found to have a sensitivity of 101V/erg/cm$^2$ at 680 nm and a residual voltage of only 0–3V. The peak sensitivity for metal-free phthalocyanine is obtained closer to 780 nm and is, for a 100 percent absorbing charge generating layer, approximately 100 V/erg/cm$^2$. Thus, obtaining the same sensitivity for the more weakly absorbed wavelength of 680 nm indicates that the charge generating layer coated from the dispersion produced by this process is certainly at least as sensitive as commonly prepared dispersions and most probably more sensitive.

EXAMPLE IV

Draw Bar Coating with the Phthalocyanine Dispersion of Example I 9 inch×11 inch conductive substrate sheets were draw-bar coated with the x-form metal free dispersion prepared in Example I to form a dried charge generating layer having a thickness of ~0.5 micrometer. A 20 micrometer thick charge transport layer was formed on the charge generating layer by draw-bar coating followed by drying at 110° C. for 25 minutes. The charge transport layer coating composition contained a 1:1 weight ratio of N,N'-diphenyl-N,N'-bis(3-methylphenyl)-1,1'-biphenyl-4-4'-diamine in polycarbonate film forming binder (available as Makrolon® from Farbenfabricken Bayer A.G.) dissolved in methylene chloride. This sample was tested electrically in a drum scanner and found to have a sensitivity of 105–110V/erg/cm$^2$ at 720 nm and a residual voltage of ≈36V. It also had a sensitivity of ≈101–107V/erg/cm$^2$ at 680 nm and a sensitivity of ≈95–100V/erg/cm$^2$ at 630 nm. The results obtained at 680 nm coincide with the 680 nm measurement in the motionless scanner on the dip-coated sample of Example III, thus establishing that neither the type of coating (draw-bar or dip) nor the type of measurement affect the results. Furthermore, the progression of sensitivities at 630 nm, 680 nm and 720 nm shows the usual spectral dependence for metal-free phthalocyanine, confirming the quality of the pigment in the end-product of this process.

EXAMPLE V

Dip-Coating with the Phthalocyanine Dispersion of Example I

A 30 mm diameter aluminum drum was dip-coated with the x-form metal free dispersion prepared in Example I to form a dried charge generating layer. A 25 micrometer thick charge transport layer was formed on the charge generating layer by the same coating method. The charge transport layer was formed from a mixture of N,N'-diphenyl-N,N'-bis(3-methylphenyl)-1,1'-biphenyl-4-4'-diamine and N,N-bis(3,4-dimethylphenyl)-biphenyl-4-amine in poly(4,4'-diphenyl-1,1'-cyclohexane carbonate (Z-type polycarbonate), dissolved in tetrahydrofuran and monochlorobenzene.

EXAMPLE VI

Electrical Testing of the Photoreceptors of Examples III–V (Coated with the Phthalocyanine Dispersion of Example I)

Sensitivities for metal-free phthalocyanine photoreceptors were 101–105V/erg/cm$^2$ for 87 percent absorbance at 670–720 nm, or 110–120Verg/cm$^2$ when scaled for maximum absorbance and a 25 micrometer thick charge transport layer containing a 1:1 weight ratio of N,N'-diphenyl-N,N'-bis(3-methylphenyl)-1,1'-biphenyl-4-4'-diamine in polycarbonate film forming binder. The drum sample of Example V was tested at 780 nm and gave a sensitivity of 116V/erg/cm$^2$. Remarkably, the strips of dip-coated samples of Example III had virtually no residual (0–3V), and the draw-bar coated sheets of Example IV showed a low ~40–50V residual.

EXAMPLE VII

Dip Coating with the above Perylene Dimer Dispersion of Example II

A conductive substrate was dip coated with the perylene dimer pigment dispersion prepared in Example II to form a dried charge generating layer having a optical density of 0.5. A 25 micrometer thick charge transport layer was formed on the charge generating layer by dip-coating. The charge transport layer was formed from a mixture of N,N'-diphenyl-N,N'-bis(3-methylphenyl)-1,1'-biphenyl-4-4'-diamine and N,N-bis(3,4-dimethylphenyl)-biphenyl-4-amine in poly(4,4'-diphenyl-1,1'-cyclohexane carbonate (Z-type polycarbonate), dissolved in tetrahydrofuran and monochlorobenzene. The sensitivity measured on a drum scanner was 105 V/erg/cm$^2$, which, when scaled for the ½ absorbance, gives an impressive 210V/erg/cm$^2$ for this perylene dimer pigment.

EXAMPLE VIII

Dispersion of Metal-Free Pthalocyanine in Polycarbonate

A 50/50 weight percent ratio of 0.6 gram of x-form metal free phthalocyanine pigment agglomerates and 0.6 gram of polyvinylbutyral copolymer (B79, available from Monsanto) were mixed together in a vessel with 35 milliliters of n-butyl acetate (BuOAc) solvent to form a 5 weight percent solids dispersion. A magnetic stir bar was used to stir the mixture. The temperature of the resulting mixture was ramped up from ambient room temperature on an adjustable hotplate which was also initially at ambient room temperature. The temperature control setting of the hot plate was then set to initially raise the temperature of the mixture to ~60° C. The temperature of the mixture was lowered to ~50° C. over a period of 20 minutes. The mixture was thereafter maintained at ~50° C. for 25 minutes. Then the temperature of the mixture was raised to 100° C. in 15–20 minutes and thereafter allowed to cool, with continued stirring, to ambient room temperature. Ramping of the temperature was important because placement of a cool vessel and contents on a preheated hot-plate can cause a glue-like sludge to form on the bottom that is extremely difficult to disperse. Since the mixture did not boil at 100° C., hardly any washing down was used during heating. The vessel was uncapped during boiling. As solvent evaporated during the boiling stage, a thin stream of solvent was slowly (so as not to rapidly cool the mixture) added to maintain the solid/solvent ratio and to wash down larger particles that were deposited on the vessel walls by the boiling and frothing. After 20 minutes of boiling, the heat setting was lowered to "1", the vessel opening was lightly capped with a glass cap, and the mixture was allowed to simmer for ~30 minutes. Solvent was added periodically in about 10–15 minute intervals to maintain solvent/solid ratios. The same process has been repeated with an identical mixture using a condenser attached to the flask so that no solvent is lost to evaporation and the same times were required for the various process steps. The mixture was stirred with the magnetic stir bar during the ramping, boiling and simmering heating periods. Upon completion of the 30 minutes of simmering, the vessel was removed from the hotplate. The resulting dispersion was judged by the naked eye. The liquid looked like paint and showed no "clouds" on swirling. When ~1 milliliter of the dispersion was squirted onto a glass plate, the blue mixture was uniform, glassy smooth, and no particles (agglomerates) were visible. This dispersion contained 0.6 gram of the phthalocyanine particles and 0.6 gram in 35 milliliters n-butyl acetate (BuOAc) and was stable for at least 8 weeks, after which it was all used up in coatings.

EXAMPLE IX

Dip-Coating with the Dispersion of Example VIII

A 30 mm diameter aluminum drum was dip-coated with the x-form metal free dispersion prepared in Example VIII to form a dried charge generating layer. A 25 micrometer thick charge transport layer was formed on the charge generating layer by the same coating method. The charge transport layer was formed from a mixture of N,N'-diphenyl-N,N'-bis(3-methylphenyl)-1,1'-biphenyl-4-4'-diamine and N,N-bis(3,4-dimethylphenyl)-biphenyl-4-amine in poly(4,4'-diphenyl-1,1'-cyclohexane carbonate (Z-type polycarbonate), dissolved in tetrahydrofuran and monochlorobenzene.

EXAMPLE X

Electrical Testing of the Photoreceptor of Example IX

The sensitivity for the metal-free phthalocyanine photoreceptor of Example IX was 127V/erg/cm$^2$ at 780 nm which is significantly better than the 100–110V/erg/cm$^2$ usually obtained with metal-free phthalocyanine photoreceptors with other binders and solvents. These results were reproduced twice over a two month period, with sensitivities consistently between 125–130V/erg/cm$^2$. The residual voltage was also low at 35V.

EXAMPLE XI

Draw Bar Coating with the Phthalocyanine Dispersion of Example VIII 9 inch×11 inch conductive substrate sheets were draw-bar coated with the x-form metal free dispersion prepared in Example VIII to form dried charge generating layers having a various thicknesses down to 0.1 micrometer. In such coatings, the particles were indistinguishable to the naked eye and the films looked uniform. Thus, a lower loading of metal-free phthalocyanine was used in order to separate and so observe and distinguish the particles. The results showed the particles strung along in filamentary structures throughout the film, with predominant particle sizes less than 0.01 micrometers and a few larger agglomerates at 0.05 micrometer.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process for forming a dispersion comprising forming a mixture comprising agglomerates of primary particles, a film forming binder and a solvent for the binder, the primary particles having an average size of less than about 500 nanometers, applying sufficient heat energy to the mixture while stirring to disintegrate the agglomerates into separate primary particles having an average size of less than about 500 nanometers to form a dispersion substantially free of agglomerates, and slowly cooling the dispersion to maintain separation between the primary particles in the dispersion.

2. A dispersion process according to claim 1 wherein the primary particles are monocrystalline particles and wherein the monocrystalline particles in the agglomerates are unaligned.

3. A process according to claim 1 wherein the primary particles have an average particle size of less than about 200 nanometers.

4. A process according to claim 1 wherein the primary particles have an average particle size of less than about 100 nanometers.

5. A process according to claim 1 wherein the primary particles have an average particle size of less than about 50 nanometers.

6. A process according to claim 1 wherein the dispersion comprises between about 10 and about 90 percent by weight pigment particles and between about 90 and about 10 percent by weight film forming polymer, based on the total weight of solids in the dispersion.

7. A process according to claim 6 wherein the total weight of the solids in the dispersion is between about 2 percent by weight and about 40 percent by weight, based on the total weight of the dispersion.

8. A process according to claim 1 including applying sufficient heat energy to the mixture to raise the temperature of the mixture between about the boiling point temperature of the mixture and a temperature about 2° C. below the boiling point of the mixture to agitate the mixture and vaporize solvent material.

9. A process according to claim 8 including applying sufficient heat energy to the mixture to boil the mixture, agitate the mixture and vaporize solvent material.

10. A process according to claim 8 including refluxing vaporized solvent.

11. A process according to claim 8 including venting while applying heat energy the mixture.

12. A process according to claim 8 including adding sufficient solvent to substantially replace vaporized solvent as solvent is being vaporized.

13. A process according to claim 8 wherein the agglomerates and primary particles have a decomposition temperature and wherein the temperature of the agglomerates and primary particles are maintained below about the decomposition temperature.

14. A process according to claim 8 wherein the solvent has a decomposition temperature and wherein the temperature of the solvent is maintained below about the decomposition temperature.

15. A process according to claim 1 including applying sufficient heat energy to the mixture to heat the mixture to a temperature between about 40° C. and about 120° C.

16. A process according to claim 1 wherein the cooling is at a rate free of quenching and substantially free of agglomerate formation.

17. A process according to claim 1 including applying heat energy to the mixture to heat the mixture at rate sufficient to maintain the mixture free of sludge formation.

18. A process according to claim 1 wherein the film forming binder is a film forming polymer.

19. A process according to claim 1 wherein the primary particles are photoconductive pigment particles.

20. A process according to claim 19 wherein the primary particles are organic photoconductive pigment particles.

21. A process according to claim 1 wherein the primary particles are perylene particles.

22. A process according to claim 1 wherein the primary particles are x-form metal free phthalocyanine particles.

23. A process according to claim 22 wherein the film forming binder is polyvinylbutyral copolymer and the solvent for the binder is n-butyl acetate.

24. A process according to claim 1 wherein the slow cooling the dispersion is accompanied by stirring to maintain separation between the primary particles in the dispersion.

25. A dispersion process according to claim 1 wherein the primary particles in the agglomerates are polycrystalline particles.

* * * * *